US011835319B2

(12) United States Patent
Est et al.

(10) Patent No.: US 11,835,319 B2
(45) Date of Patent: Dec. 5, 2023

(54) GUIDED PROJECTILE AND COUNTERMEASURE SYSTEMS AND METHODS FOR USE THEREWITH

(71) Applicant: The Boeing Company, Chicago, IL (US)

(72) Inventors: Brian Edward Est, Lake St. Louis, MO (US); Leslie Leon Palmer, University City, MO (US)

(73) Assignee: The Boeing Company, Arlington, VA (US)

( * ) Notice: Subject to any disclaimer, the term of this patent is extended or adjusted under 35 U.S.C. 154(b) by 0 days.

(21) Appl. No.: 17/664,679

(22) Filed: May 24, 2022

(65) Prior Publication Data

US 2023/0045482 A1 Feb. 9, 2023

Related U.S. Application Data

(60) Provisional application No. 63/197,575, filed on Jun. 7, 2021.

(51) Int. Cl.

| | |
|---|---|
| ***F41G 7/22*** | (2006.01) |
| ***F42B 10/50*** | (2006.01) |
| *F41G 7/00* | (2006.01) |

(52) U.S. Cl.

CPC ..... *F41G 7/224* (2013.01); *F42B 10/50* (2013.01)

(58) Field of Classification Search

CPC ..... F41G 7/224; F42B 10/50; F42B 10/54; F42B 10/64

See application file for complete search history.

(56) References Cited

U.S. PATENT DOCUMENTS

| | | | | |
|---|---|---|---|---|
| 2,709,054 A * | 5/1955 | Roth | B64D 17/80 | 200/61.18 |
| 3,047,259 A * | 7/1962 | Tatnall | F42B 10/50 | 244/158.9 |
| 3,228,634 A * | 1/1966 | Chakoian | F42B 10/50 | 102/388 |
| 4,005,655 A * | 2/1977 | Kleinschmidt | F42B 10/50 | 102/386 |

(Continued)

FOREIGN PATENT DOCUMENTS

| | | | |
|---|---|---|---|
| EP | 3667226 A1 * | 6/2020 | F42B 10/48 |
| WO | WO2008/143707 A2 * | 11/2008 | F42B 10/54 |

*Primary Examiner* — Bernarr E Gregory

(74) *Attorney, Agent, or Firm* — Armstrong Teasdale LLP

(57) ABSTRACT

A guided projectile including a projectile housing, a first sensor, and an air brake detachably coupled to the projectile housing. The air brake is deployable from a flight configuration to a braking configuration. A processor is configured to monitor, based on data received from the first sensor, a proximity of the at least one intercepting object relative to the guided projectile, wherein the guided projectile is configured to advance towards a target location on a first target trajectory. The processor is also configured to deploy the air brake to cause the guided projectile to veer from the first target trajectory to evade the at least one intercepting object, and detach the air brake from the guided projectile to enable the guided projectile to advance on a second target trajectory that is offset from the first target trajectory, wherein the first target trajectory and the second target trajectory have the same target location.

20 Claims, 4 Drawing Sheets

(56) References Cited

U.S. PATENT DOCUMENTS

| | | | | |
|---|---|---|---|---|
| 4,145,917 | A * | 3/1979 | Brazhnikov | G01N 29/032 73/64.53 |
| 4,504,031 | A * | 3/1985 | Andrews | B64G 1/62 244/113 |
| 4,624,424 | A * | 11/1986 | Pinson | F42B 10/50 244/3.28 |
| 6,502,785 | B1 * | 1/2003 | Teter | F42B 10/64 244/3.28 |
| 6,666,402 | B2 * | 12/2003 | Rupert | F42B 10/50 244/3.1 |
| 7,004,424 | B1 * | 2/2006 | Pacchia | F42B 10/64 102/400 |
| 7,229,048 | B1 * | 6/2007 | August | B64G 1/62 244/159.3 |
| 7,431,237 | B1 | 10/2008 | Mock et al. | |
| 7,611,095 | B1 * | 11/2009 | Alban, III | F42B 10/62 244/158.7 |
| 7,800,032 | B1 * | 9/2010 | Facciano | F42B 10/64 244/3.25 |
| 8,026,465 | B1 * | 9/2011 | Fraysse, Jr. | F42B 10/54 244/3.22 |
| 2001/0039898 | A1 * | 11/2001 | Bar | F42B 10/50 244/3.28 |
| 2002/0088897 | A1 * | 7/2002 | Davis | F42B 10/48 244/3.24 |
| 2014/0216290 | A1 | 8/2014 | Yee et al. | |
| 2017/0268855 | A1 | 9/2017 | McAllister et al. | |

* cited by examiner

GUIDED PROJECTILE AND COUNTERMEASURE SYSTEMS AND METHODS FOR USE THEREWITH

CROSS-REFERENCE TO RELATED APPLICATIONS

This application claims the benefit of U.S. Provisional Patent Application Ser. No. 63/197,575, filed on Jun. 7, 2021, the entire contents of which are hereby incorporated by reference in their entirety.

FIELD

The field relates generally to guided projectiles and, more specifically, to countermeasure systems and methods for use with guided projectiles.

BACKGROUND

At least some known air-defense systems protect a target, such as a vehicle, a shelter, or a building, by detecting and then intercepting an attacking projectile with a defensive projectile. In such a scenario, the attacking projectile is launched towards an intended target and the defensive projectile is launched towards the attacking projectile. At least some known attacking projectiles may be equipped with a countermeasure system that enables it to attempt to evade the defensive projectile and improve its ability to reach its intended target. Such countermeasure systems include electronic jamming systems, low observability and/or radar avoidance materials, and programming that causes the attacking projectile to perform evasive maneuvers. Such countermeasure systems are typically state-of-the-art, complex, and expensive to implement.

This section is intended to introduce the reader to various aspects of art that may be related to various aspects of the disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

BRIEF DESCRIPTION

One aspect is a guided projectile including a projectile housing, a first sensor, and an air brake detachably coupled to the projectile housing. The air brake is deployable from a flight configuration to a braking configuration. A processor is configured to monitor, based on data received from the first sensor configured to detect approach of an intercepting object, a proximity of the at least one intercepting object relative to the guided projectile, wherein the guided projectile is configured to advance towards a target location on a first target trajectory. The processor is also configured to deploy the air brake to cause the guided projectile to veer from the first target trajectory to establish a separation distance from the at least one intercepting object to evade the at least one intercepting object, and detach the air brake from the guided projectile to enable the guided projectile to advance on a second target trajectory that is offset from the first target trajectory, wherein the first target trajectory and the second target trajectory have the same target location.

Another aspect is a countermeasure system for use with a guided projectile. The countermeasure system includes a first sensor and an air brake detachably coupled to the guided projectile, wherein the air brake is deployable from a flight configuration to a braking configuration. A processor is configured to monitor, based on data received from the first sensor configured to detect approach of an intercepting object, a proximity of the at least one intercepting object relative to the guided projectile, wherein the guided projectile is configured to advance towards a target location on a first target trajectory. The processor is also configured to deploy the air brake to cause the guided projectile to veer from the first target trajectory to establish a separation distance from the at least one intercepting object to evade the at least one intercepting object, and detach the air brake from the guided projectile to enable the guided projectile to advance on a second target trajectory that is offset from the first target trajectory, wherein the first target trajectory and the second target trajectory have the same target location.

Yet another aspect is a method of evading at least one intercepting object. The method includes monitoring, based on data received from a first sensor onboard a guided projectile configured to detect approach of an intercepting object, a proximity of the at least one intercepting object relative to the guided projectile, wherein the guided projectile is configured to advance towards a target location on a first target trajectory. The method also includes deploying an air brake onboard the guided projectile to cause the guided projectile to veer from the first target trajectory to establish a separation distance from the at least one intercepting object to evade the at least one intercepting object, and detaching the air brake from the guided projectile to enable the guided projectile to advance on a second target trajectory that is offset from the first target trajectory. The first target trajectory and the second target trajectory have the same target location.

Various refinements exist of the features noted in relation to the above-mentioned aspects of the present disclosure. Further features may also be incorporated in the above-mentioned aspects of the present disclosure as well. These refinements and additional features may exist individually or in any combination. For instance, various features discussed below in relation to any of the illustrated embodiments of the present disclosure may be incorporated into any of the above-described aspects of the present disclosure, alone or in any combination.

BRIEF DESCRIPTION OF THE DRAWINGS

Corresponding reference characters indicate corresponding parts throughout the drawings.

DETAILED DESCRIPTION

Examples described include countermeasure systems and methods for use with guided projectiles. Example systems and methods include a sensor onboard the guided projectile that is configured to monitor the proximity of incoming an air-defense projectile, and an air brake that is detachably coupled to the guided projectile. When the guided projectile is in flight, the air brake is deployable from a flight configuration to a braking configuration, which causes the guided projectile to rapidly decelerate and lose altitude. This evasive maneuver creates a marked change in the guided projectile's trajectory to avoid the air-defense projectile's intercept trajectory. The air-defense projectile has limited maneuvering capabilities such that, if timed correctly, deployment of the air brake prevents the air-defense projectile from compensating for the rapid deceleration and altitude loss of the guided projectile. Once the guided projectile has passed the lethal kill radius of the air-defense projectile, the air brake may be detached from the guided projectile to cause it to re-accelerate and re-maneuver towards its intended target. Accordingly, the systems and methods described herein provide effective means for countering air-defense systems and increasing the likelihood of a payload reaching its intended target.

As used herein, an element or step recited in the singular and preceded with the word "a" or "an" should be understood as not excluding plural elements or steps, unless such exclusion is explicitly recited. Furthermore, references to "example", "example implementation" or "one implementation" of the present disclosure are not intended to be interpreted as excluding the existence of additional implementations that also incorporate the recited features.

Figure 1:
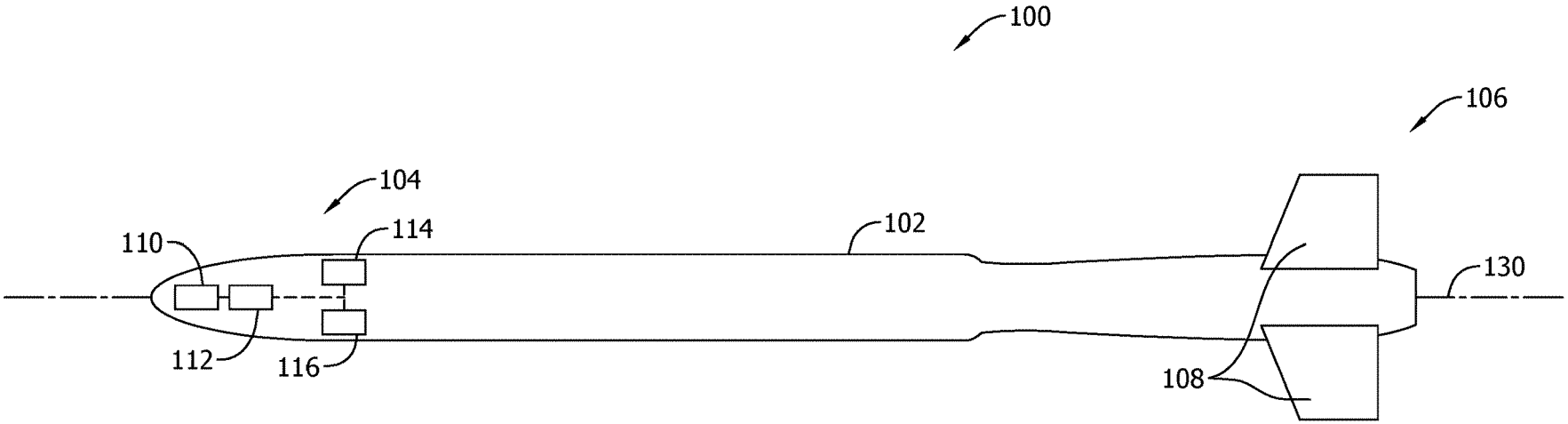
FIG. 1 is a schematic illustration of an example guided projectile.

FIG. 1 is a schematic illustration of an example guided projectile 100. In the example implementation, guided projectile 100 includes a projectile housing 102, and is defined by at least a nose section 104 and a tail section 106. A plurality of control fins 108 are coupled to tail section 106. Control fins 108 enable guided projectile 100 to be maneuvered while in in flight. Guided projectile 100 further includes at least one sensor, such as a first sensor 110 and a second sensor 112. In one implementation, first sensor 110 is configured to identify, track, and/or monitor at least one intercepting object approaching guided projectile 100 and its proximity to guided projectile 100. Such sensing may be provided via infrared, radiofrequency, and/or optical sensing technology. Second sensor 112 is configured to monitor at least one of an air speed or an altitude of guided projectile 100.

As will be described in more detail below, operation of guided projectile 100 may be controlled by a controller including a memory 114 and a processor 116, including hardware and software, coupled to memory 114 for executing programmed instructions. Processor 116 may include one or more processing units (e.g., in a multi-core configuration) and/or include a cryptographic accelerator (not shown). Guided projectile 100 is programmable to perform one or more operations described herein by programming memory 114 and/or processor 116. For example, processor 116 may be programmed by encoding an operation as executable instructions and providing the executable instructions in memory 114.

Processor 116 may include, but is not limited to, a general purpose central processing unit (CPU), a microcontroller, a microprocessor, a reduced instruction set computer (RISC) processor, an open media application platform (OMAP), an application specific integrated circuit (ASIC), a programmable logic circuit (PLC), and/or any other circuit or processor capable of executing the functions described herein. The methods described herein may be encoded as executable instructions embodied in a computer-readable medium including, without limitation, a storage device and/or a memory device. Such instructions, when executed by processor 116, cause processor 116 to perform at least a portion of the functions described herein. The above examples are for example purposes only, and thus are not intended to limit in any way the definition and/or meaning of the term processor.

Memory 114 is one or more devices that enable information such as executable instructions and/or other data to be stored and retrieved. Memory 114 may include one or more computer-readable media, such as, without limitation, dynamic random access memory (DRAM), synchronous dynamic random access memory (SDRAM), static random access memory (SRAM), a solid state disk, and/or a hard disk. Memory 114 may be configured to store, without limitation, executable instructions, operating systems, applications, resources, installation scripts and/or any other type of data suitable for use with the methods and systems described herein.

Instructions for operating systems and applications are located in a functional form on non-transitory memory 114 for execution by processor 116 to perform one or more of the processes described herein. These instructions in the different implementations may be embodied on different physical or tangible computer-readable media, such as memory 114 or another memory, such as a computer-readable media (not shown), which may include, without limitation, a flash drive and/or thumb drive. Further, instructions may be located in a functional form on non-transitory computer-readable media, which may include, without limitation, smart-media (SM) memory, compact flash (CF) memory, secure digital (SD) memory, memory stick (MS) memory, multimedia card (MMC) memory, embedded-multimedia card (e-MMC), and micro-drive memory. The computer-readable media may be selectively insertable and/or removable to permit access and/or execution by processor 116. In an alternative implementation, the computer-readable media is not removable.

Figure 2:
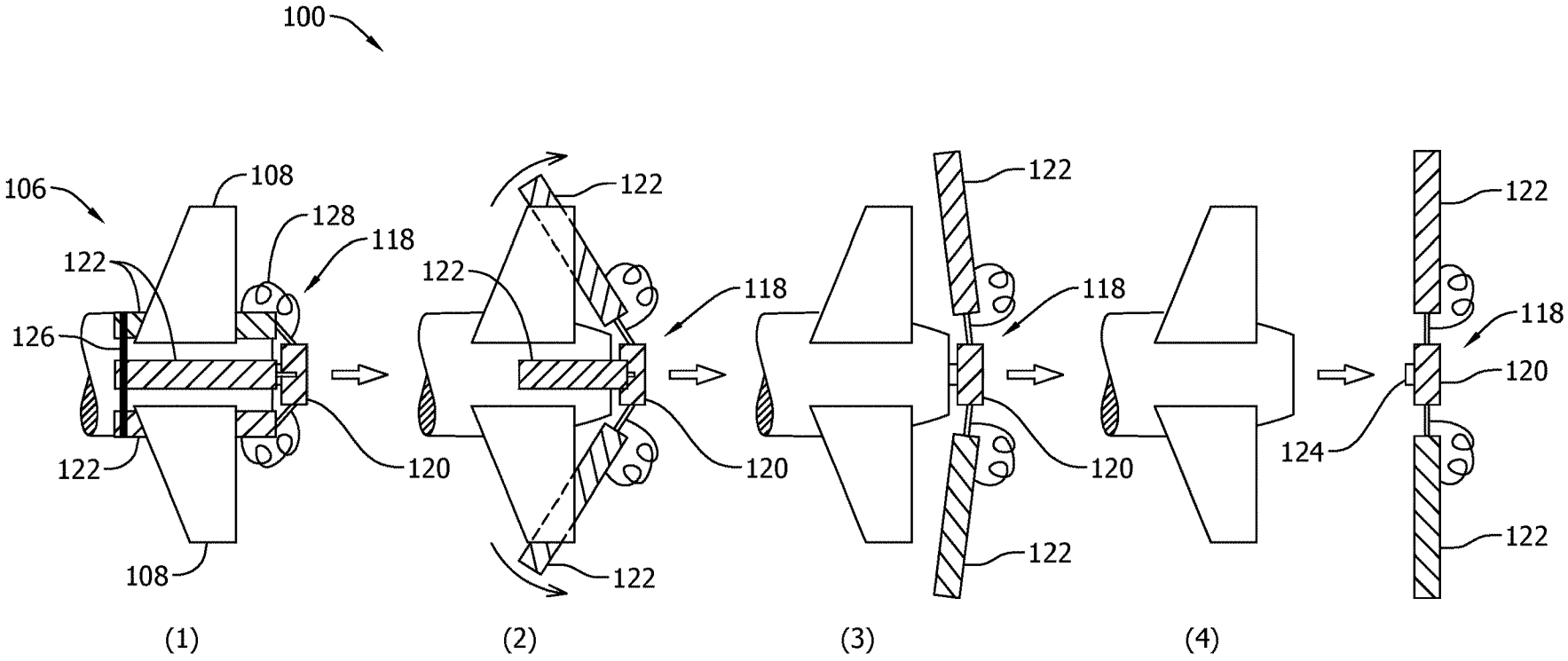
FIG. 2 is a progression view of a tail section of the guided projectile, the tail section including an air brake that is deployed and then detached in the progression view.

FIG. 2 is a sectional progression view of tail section 106 of guided projectile 100, wherein progression views (1)-(4) illustrate deployment of an air brake 118 onboard guided projectile 100 from a flight configuration (1), to a partially deployed configuration (2), to a deployed configuration (3), to detachment (4) from guided projectile 100. In the example implementation, air brake 118 is detachably coupled to projectile housing 102. Air brake 118 includes a base plate 120 detachably coupled to projectile housing 102, and a plurality of air fins 122 coupled to base plate 120. Base plate 120 may be detachably coupled to projectile housing 102 with any detachment mechanism 124 that enables guided projectile 100 to function as described herein. Example detachment mechanisms include, but are not limited to, a pyrotechnic fastener and/or a mechanical release device.

As illustrated in progression view (1), air fins 122 are positioned against projectile housing 102 when in the flight configuration. Air fins 122 may be retained against projectile housing 102 to reduce drag on guided projectile 100. Air fins 122 are retained with any release mechanism that enables guided projectile 100 to function as described herein. In the example implementation, the release mechanism is a retention band 126 wrapped circumferentially around each air fin 122 and projectile housing 102. As will be described in more detail below, retention band 126 may be severed upon detection of an approaching intercepting object. Severance may be made with a pyrotechnic cutting charge embedded within retention band 126, for example, whose ignition is controlled by processor 116.

Severing retention band 126, or releasing air fins 122 by other means, enables air fins 122 to be deployed to the braking configuration. For example, as illustrated in progression view (2), air fins 122 are rotatable relative to base plate 120 when deployed from the flight configuration. In one implementation, deployment of air fins 122 is initiated with a spring 128 defined at a joint between base plate 120 and each air fin 122. Alternatively, the deployment may be initiated as a result of wind resistance impingement against air fins 122 while guided projectile 100 is in flight.

As illustrated in progression view (3), air fins 122 are fully deployed. When fully deployed, air fins 122 are designed to generate air resistance against guided projectile 100 to cause its rapid deceleration and a loss in altitude. Accordingly, air fins 122 are shaped, and have any orientation relative to guided projectile 100, that enables guided projectile 100 to function as described herein. For example, air fins 122 are sized based on the projectile's mass to create drag capable of generating a large trajectory offset of the incoming projectile to the intercepting projectile lethality zone. Air fins 122 are shaped to maximize drag while providing sufficient structural integrity to survive the opening shock of deployment. In addition, air fins 122 may be oriented at least one of orthogonally or perpendicularly relative to a longitudinal axis 130 (shown in FIG. 1) of guided projectile 100 to generate the air resistance.

As illustrated in progression view (4), and as discussed above, air brake 118 is detachably coupled to projectile housing 102. For example, base plate 120 may be coupled to guided projectile 100 with a detachment mechanism 124, such as a pyrotechnic bolt. As will be described in more detail below, activation of detachment mechanism 124 to detach air brake 118, including base plate 120 and air fins 122, from guided projectile 100 is controlled based on a proximity of an intercepting object relative to guided projectile 100.

Figure 3:
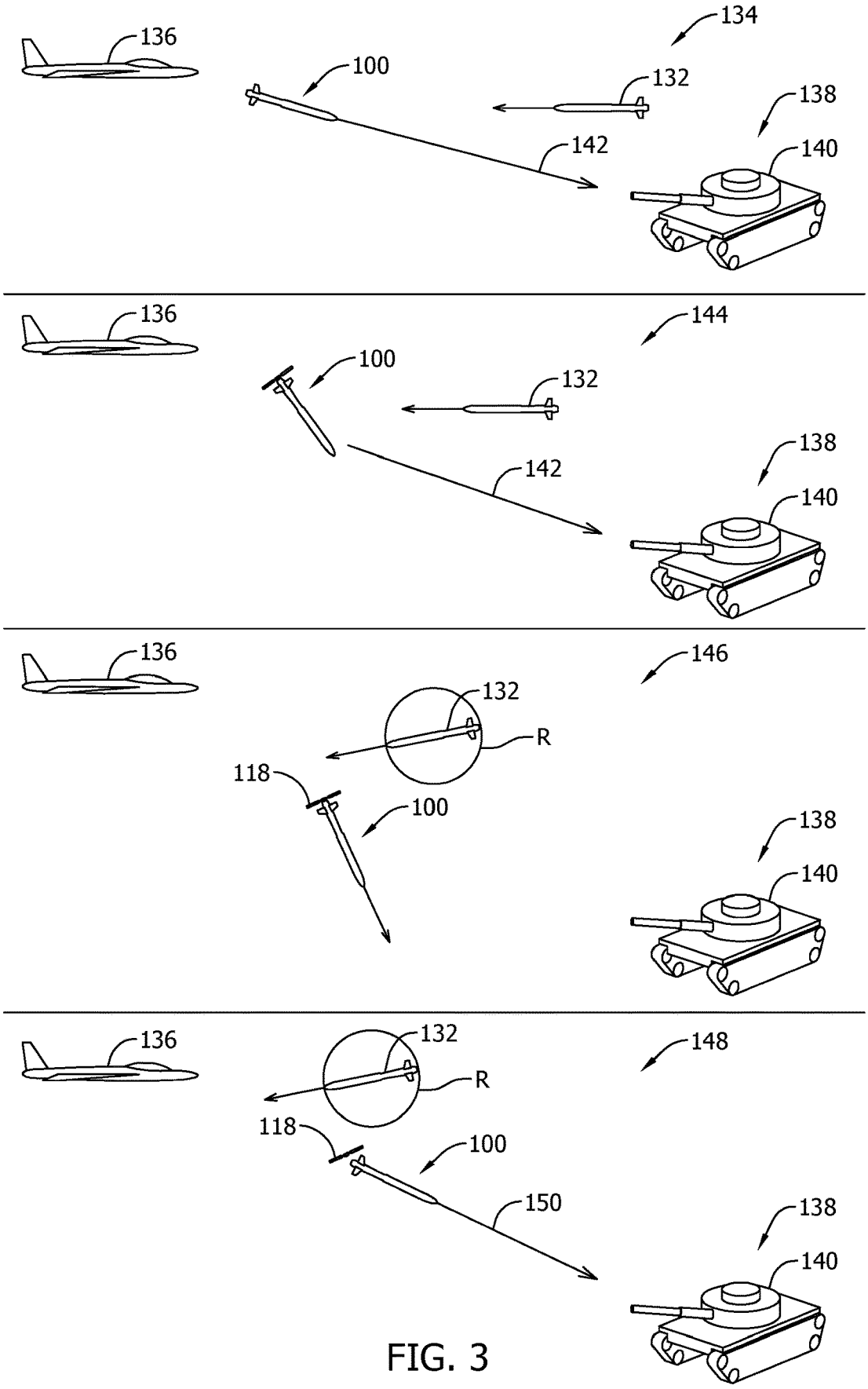
FIG. 3 is a progression view illustrating a method of evading a single intercepting object.

FIG. 3 is a progression view illustrating a method of evading a single intercepting object 132. In the first illustration 134, guided projectile 100 is launched from an aircraft 136 towards a target location 138, which in this case is a ground vehicle 140. Guided projectile 100 initially travels along a first target trajectory 142 towards target location 138. While guided projectile 100 is in flight, processor 116 (shown in FIG. 1) monitors for the presence of approaching objects that may intercept guided projectile 100 on first target trajectory 142. For example, the proximity of intercepting object 132 relative to guided projectile 100 may be monitored based on data received from first sensor 110 (shown in FIG. 1).

As shown in the second illustration 144, the processor 116 monitors the first sensor 110 configured for detecting when the intercepting object 132 is within a predetermined proximity, in response to which the processor 116 initiates detachment mechanism to deploy the air brake 118 to cause the guided projectile 100 to rapidly decelerate and veer from the first target trajectory 142 towards an altered trajectory beneath intercepting object 132. As shown in the third illustration 146, intercepting object 132 has a lethal kill radius R. Lethal kill radius R is a distance from intercepting object 132 in which, when a payload onboard intercepting object 132 is detonated, guided projectile 100 will be disabled and/or unable to continue towards target location 138. In the example implementation, upon detecting that the intercepting object 132 is within a predetermined proximity, the air brake 118 is deployed to cause guided projectile 100 to veer from first target trajectory 142 towards an altered trajectory, and the air brake 118 remains deployed for a duration to establish a separation distance from the at least one intercepting object to evade intercepting object 132 and its lethal kill radius R. For example, air brake 118 may remain deployed until a separation distance between the trajectory of the intercepting object 132 and the altered trajectory of the guided projectile 100 is greater than lethal kill radius R. By deploying air brake 118 for a duration until the separation distance is greater than the kill radius R, guided projectile 100 is able to perform an evasive maneuver to bring guided projectile 100 outside a maneuvering radius of intercepting object 132. In other words, the maneuvering radius and/or capabilities of intercepting object 132 are limited in compensating for the rapid deceleration and/or loss in altitude of guided projectile 100 as a result of deployment of air brake 118.

As shown in the fourth illustration 148, air brake 118 may be detached from guided projectile 100 when it is determined intercepting object 132 has been evaded. Detaching air brake 118 from guided projectile 100 causes the air brake 118 to be jettisoned from the guided projectile 100 and enables guided projectile 100 to advance on a second target trajectory 150 that is offset from first target trajectory 142 as a result of the loss in altitude from deployment of air brake 118. In one example, guided projectile 100 is programmed to detach air brake 118 based on time, such as after a predetermined amount of time has elapsed. The predetermined amount of time may be calculated starting from when air fins 122 (shown in FIG. 2) are released, for example. The predetermined amount of time may be 0.1 seconds, 0.5 seconds, 1 second, 2 seconds, 5 seconds, 10 seconds, and/or any range therebetween.

The determination that intercepting object 132 has been evaded, and of when to detach air brake 118, may also be made based on measurements determined by first and/or second sensors 110 and 112. In one example, first sensor 110 continuously monitors the distance between intercepting object 132 and guided projectile 100 as intercepting object 132 approaches guided projectile 100 when on an intercept trajectory, and as intercepting object 132 distances from guided projectile 100 upon performance of the evasive maneuver. Accordingly, air brake 118 may be detached from guided projectile 100 when the distance between guided projectile 100 and intercepting object 132 is greater than a predetermined threshold that is greater than lethal kill radius R. Lethal kill radius R may be determined based on measurements taken by first sensor 110. For example, first sensor 110 may be capable of monitoring the size of an exhaust plume and/or an approaching speed of intercepting object 132 to identify the type and size, and thus the lethal kill radius R, of intercepting object 132. Alternatively, guided projectile 100 may operate based on an estimated size of lethal kill radius R that is pre-programmed into guided projectile 100.

In addition, second sensor 112 monitors at least one of an air speed or an altitude of guided projectile 100 throughout flight and, specifically, while air brake 118 is deployed. In one example, air brake 118 is detached when at least one of the air speed or the altitude is less than a respective minimum threshold. The minimum thresholds may be determined based on the air speed and remaining altitude required for guided projectile 100 to re-accelerate, after air brake 118 is detached, and reach target location 138. In some implementations, this determination of when to detach air brake 118 is a failsafe that overrides all other air brake detachment control programs.

Figure 4:
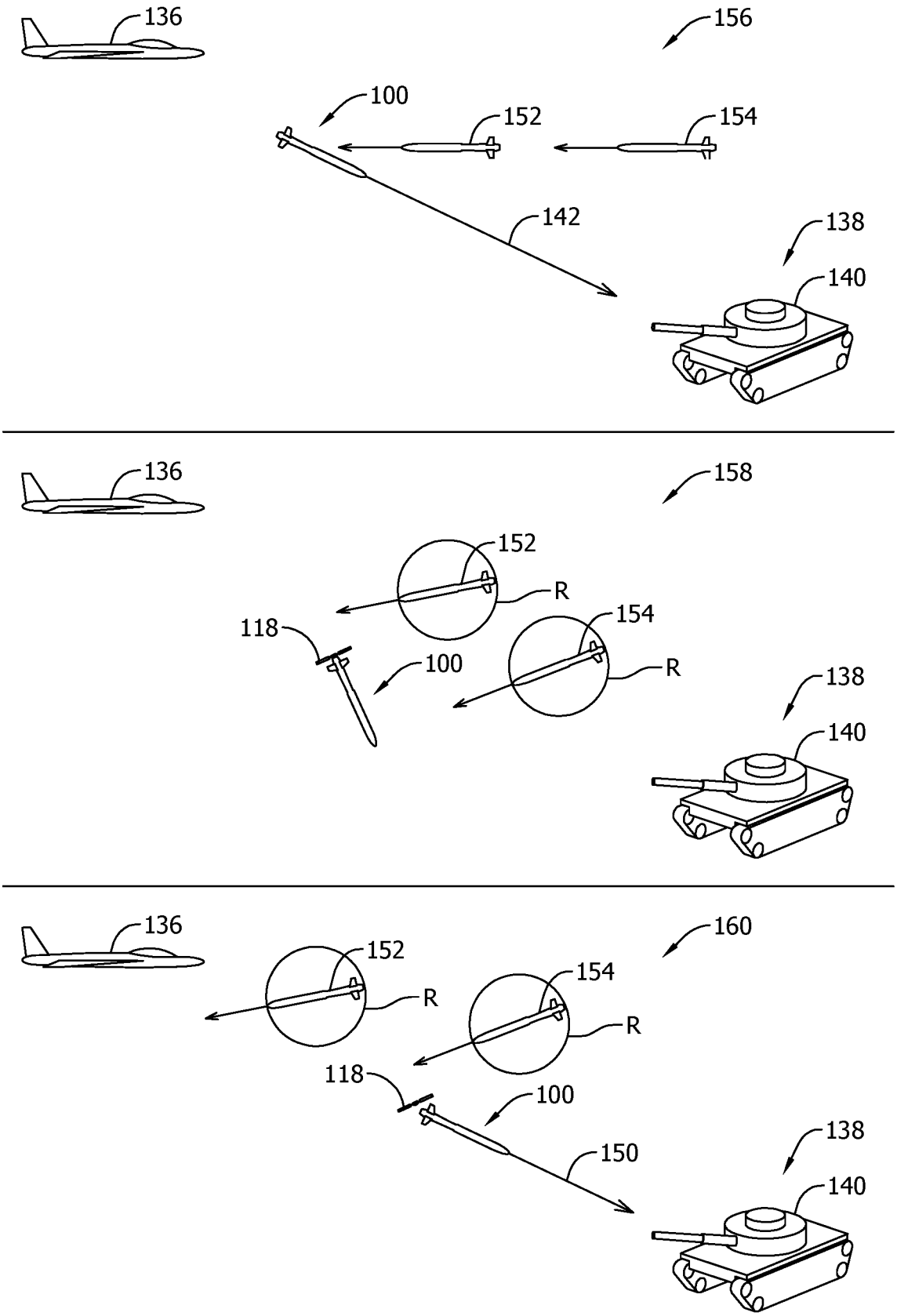
FIG. 4 is a progression view illustrating a method of evading more than one intercepting object.

FIG. 4 is a progression view illustrating a method of evading more than one intercepting object, such as a first intercepting object 152 and a second intercepting object 154. As shown in the first and second illustrations 156 and 158, guided projectile 100 evades first intercepting object 152 by deploying air brake 118 as described above. As shown in the second illustration 158, although first intercepting object 152 has been evaded, second intercepting object 154 may alter its trajectory to intercept guided projectile 100. Accordingly, as shown in the third illustration 160, detachment of air brake 118 is controlled to enable guided projectile 100 to evade second intercepting object 154 by accelerating at a rate that maneuvers guided projectile 100 away from second intercepting object 154.

Guided projectile 100 may be programmed to detach air brake 118 based on time and/or based on a proximity of second intercepting object 154 relative to guided projectile. For example, air brake 118 may be detached after the predetermined amount of time discussed above, and an additional amount of time, has elapsed. The additional amount of time may be added when it is determined second intercepting object 154 is present. Alternatively, air brake 118 may be detached from guided projectile 100 when the distance between guided projectile 100 and second intercepting object 154 is greater than a predetermined threshold that is greater than lethal kill radius R, as discussed above.

This written description uses examples to disclose various implementations, including the best mode, and also to enable any person skilled in the art to practice the various implementations, including making and using any devices or systems and performing any incorporated methods. The patentable scope of the disclosure is defined by the claims, and may include other examples that occur to those skilled in the art after reading this specification. Such other examples are intended to be within the scope of the claims if they have structural elements that do not differ from the literal language of the claims, or if they include equivalent structural elements with insubstantial differences from the literal language of the claims.

What is claimed is:

1. A guided projectile comprising:
a projectile housing;
a first sensor configured to detect approach of an intercepting object;
an air brake detachably coupled to the projectile housing, wherein the air brake is deployable from a flight configuration to a braking configuration; and
a processor configured to:
monitor, based on data received from the first sensor, a proximity of the at least one intercepting object relative to the guided projectile, wherein the guided projectile is configured to advance towards a target location on a first target trajectory;
deploy the air brake when the intercepting object is within a predetermined proximity, to cause the guided projectile to veer from the first target trajectory to establish a separation distance to evade the at least one intercepting object; and
detach the air brake from the guided projectile to enable the guided projectile to advance on a second target trajectory that is offset from the first target trajectory, wherein the first target trajectory and the second target trajectory have the same target location.

2. The guided projectile in accordance with claim 1, wherein, when deployed to the braking configuration, the air brake causes the guided projectile to decelerate and lose altitude.

3. The guided projectile in accordance with claim 1, wherein the air brake comprises a plurality of air fins positioned against the projectile housing when in the flight configuration, and oriented at least one of orthogonally or perpendicularly relative to a longitudinal axis of the guided projectile when in the braking configuration.

4. The guided projectile in accordance with claim 3, wherein the air brake further comprises a base plate coupled to the plurality of air fins, wherein the base plate is detachably coupled to the projectile housing.

5. The guided projectile in accordance with claim 3, wherein the air brake comprises a release mechanism configured to retain the plurality of air fins against the projectile housing, and configured to selectively release the plurality of air fins for deployment to the braking configuration.

6. The guided projectile in accordance with claim 1 further comprising a second sensor, wherein the processor is further configured to:
monitor, based on data received from the second sensor, at least one of an air speed or an altitude of the guided projectile; and
detach the air brake from the projectile housing when at least one of the air speed or the altitude is reduced to less than a respective minimum threshold.

7. A countermeasure system for use with a guided projectile, the countermeasure system comprising:
a first sensor configured to detect approach of an intercepting object;
an air brake detachably coupled to the guided projectile, wherein the air brake is deployable from a flight configuration to a braking configuration; and
a processor configured to:
monitor, based on data received from the first sensor, a proximity of the at least one intercepting object relative to the guided projectile, wherein the guided projectile is configured to advance towards a target location on a first target trajectory;
deploy the air brake to cause the guided projectile to veer from the first target trajectory to evade the at least one intercepting object; and
detach the air brake from the guided projectile to enable the guided projectile to advance on a second target trajectory that is offset from the first target trajectory, wherein the first target trajectory and the second target trajectory have the same target location.

8. The countermeasure system in accordance with claim 7, wherein, when deployed to the braking configuration, the air brake causes the guided projectile to decelerate and lose altitude.

9. The countermeasure system in accordance with claim 7, wherein the air brake comprises a plurality of air fins positioned against the projectile housing when in the flight configuration, and oriented at least one of orthogonally or perpendicularly relative to a longitudinal axis of the guided projectile when in the braking configuration.

10. The countermeasure system in accordance with claim 9, wherein the air brake further comprises a base plate coupled to the plurality of air fins, wherein the base plate is detachably coupled to the projectile housing.

11. The countermeasure system in accordance with claim 9, wherein the air brake comprises a release mechanism configured to retain the plurality of air fins against the projectile housing, and configured to selectively release the plurality of air fins for deployment to the braking configuration.

12. The countermeasure system in accordance with claim 7 further comprising a second sensor, wherein the processor is further configured to:
monitor, based on data received from the second sensor, at least one of an air speed or an altitude of the guided projectile; and detach the air brake from the projectile housing when at least one of the air speed or the altitude is reduced to less than a respective minimum threshold.

13. A method of evading at least one intercepting object, the method comprising:

monitoring, based on data received from a first sensor onboard a guided projectile configured to detect approach of an intercepting object, a proximity of the at least one intercepting object relative to the guided projectile, wherein the guided projectile is configured to advance towards a target location on a first target trajectory;

deploying an air brake onboard the guided projectile to cause the guided projectile to veer from the first target trajectory to evade the at least one intercepting object; and detaching the air brake from the guided projectile to enable the guided projectile to advance on a second target trajectory that is offset from the first target trajectory, wherein the first target trajectory and the second target trajectory have the same target location.

14. The method in accordance with claim 13, wherein deploying the air brake comprises deploying the air brake when a distance between the at least one intercepting object and the guided projectile is less than a predetermined threshold.

15. The method in accordance with claim 13, wherein detaching the air brake comprises:

monitoring a proximity of the guided projectile relative to the at least one intercepting object after the air brake has been deployed; and detaching the air brake when a distance between the guided projectile and the at least one intercepting object is greater than a predetermined threshold.

16. The method in accordance with claim 13, wherein detaching the air brake comprises:

determining a kill radius of the at least one intercepting object; and detaching the air brake when a distance between the guided projectile and the at least one intercepting object is greater than the kill radius.

17. The method in accordance with claim 13, wherein detaching the air brake comprises:

monitoring a proximity of a first intercepting object and a second intercepting object relative to the guided projectile; and detaching the air brake based on the proximity of the second intercepting object relative to the guided projectile, wherein detaching the air brake enables the guided projectile to accelerate to evade the second intercepting object.

18. The method in accordance with claim 13, wherein detaching the air brake comprises detaching the air brake after a predetermined amount of time has elapsed, the predetermined amount of time based on how long the air brake has been deployed.

19. The method in accordance with claim 18, wherein detaching the air brake comprises:

monitoring for a first intercepting object and a second intercepting object approaching the guided projectile; and detaching, when the second intercepting object is present, the air brake after the predetermined amount of time and an additional amount of time has elapsed.

20. The method in accordance with claim 13, wherein detaching the air brake comprises:

monitoring at least one of an air speed or an altitude of the guided projectile; and detaching the air brake from the projectile housing when at least one of the air speed or the altitude is less than a respective minimum threshold.

* * * * *